US005181300A

United States Patent [19]

Schwarz

[11] Patent Number: 5,181,300

[45] Date of Patent: Jan. 26, 1993

[54] WAISTBAND FASTENER

[75] Inventor: Michael Schwarz, Herne, Fed. Rep. of Germany

[73] Assignee: Schaeffer GmbH, Wuppertal, Fed. Rep. of Germany

[21] Appl. No.: 787,572

[22] Filed: Nov. 4, 1991

[30] Foreign Application Priority Data

Nov. 12, 1990 [DE] Fed. Rep. of Germany ..... 4035933
Mar. 8, 1991 [DE] Fed. Rep. of Germany ..... 4107435

[51] Int. Cl.[5] ..... A44B 19/00

[52] U.S. Cl. ..... 24/585; 24/68 R; 24/170

[58] Field of Search ..... 24/585, 580, 170, 191, 24/68 R, 387

[56] References Cited

U.S. PATENT DOCUMENTS

| | | | |
|---|---|---|---|
| 2,171,448 | 8/1939 | Holtz | 24/585 |
| 3,872,554 | 3/1975 | Wolfertz et al. | 24/68 R |
| 3,950,827 | 4/1976 | Kanzaka et al. | 24/585 |
| 4,180,891 | 1/1980 | Stocker | 24/68 R |
| 4,545,096 | 10/1985 | Belter et al. | 24/585 |
| 4,578,827 | 4/1986 | Appelt | 2/221 |
| 4,780,939 | 11/1988 | Belter et al. | 24/585 |
| 4,945,616 | 8/1990 | Okano | 24/585 |

FOREIGN PATENT DOCUMENTS

| | | |
|---|---|---|
| 0092662 | 11/1983 | European Pat. Off. . |
| 2505432 | 8/1976 | Fed. Rep. of Germany . |
| 2800288 | 7/1979 | Fed. Rep. of Germany . |
| 3340642 | 6/1985 | Fed. Rep. of Germany . |
| 1578302 | 4/1978 | United Kingdom . |

*Primary Examiner*—Victor N. Sakran
*Attorney, Agent, or Firm*—Gottlieb, Rackman & Reisman

[57] ABSTRACT

The invention relates to a waistband fastener, especially for trousers, skirts or the like, comprising a latch rail (1) fixed to a waistband portion (A) and bearing a plurality of sawtooth-like teeth (3), on which latch rail a slider (2) connected to the other waistband portion (B) is guided in an adjustable and latchable manner. To enable a simple and advantageous handling and operation of the fastener, a latch finger (12) can be selectively brought into and out of engagement with the teeth of the latch rail by means of a transverse shifting of the slider away from and toward the latch rail. In the first case, the latch finger simply slides over the teeth, by virtue of riding up on their sloping faces, when the slider is moved in one direction (arrow y) along the latch rail. In the other case, the latch finger is shifted out of the tooth gaps (4) and clear of the teeth to permit movement of the slider in the opposite direction.

48 Claims, 13 Drawing Sheets

V
V
B
A
1
2
11
12
23
24
25
26
27
28
a
b

A
B
1
2
3
4
11
12
23
25
26
27
a

FIG.10
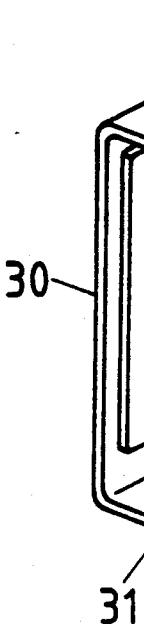
FIG.9
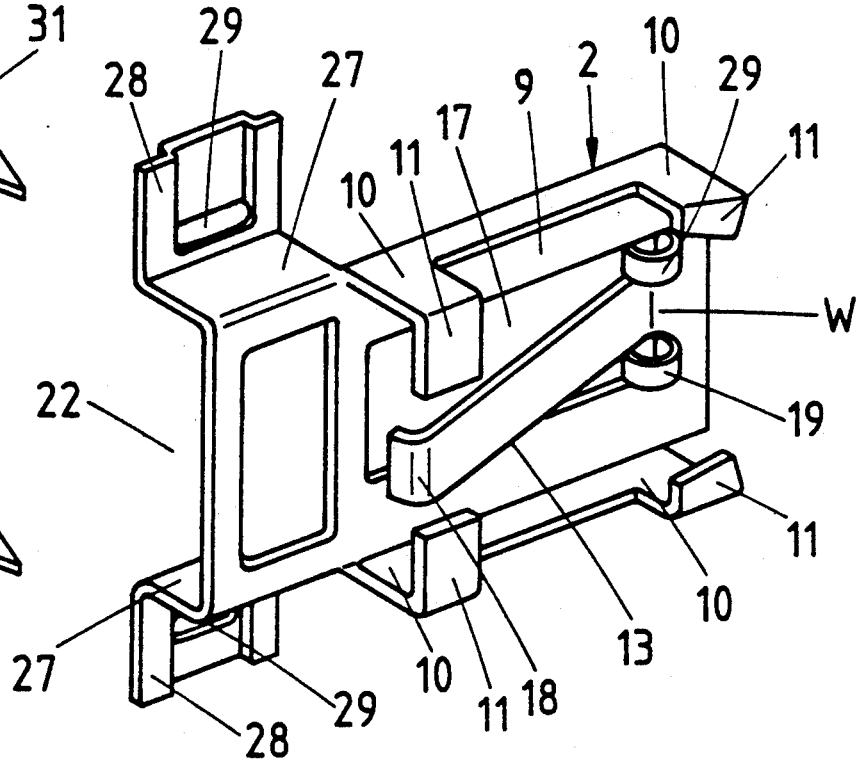
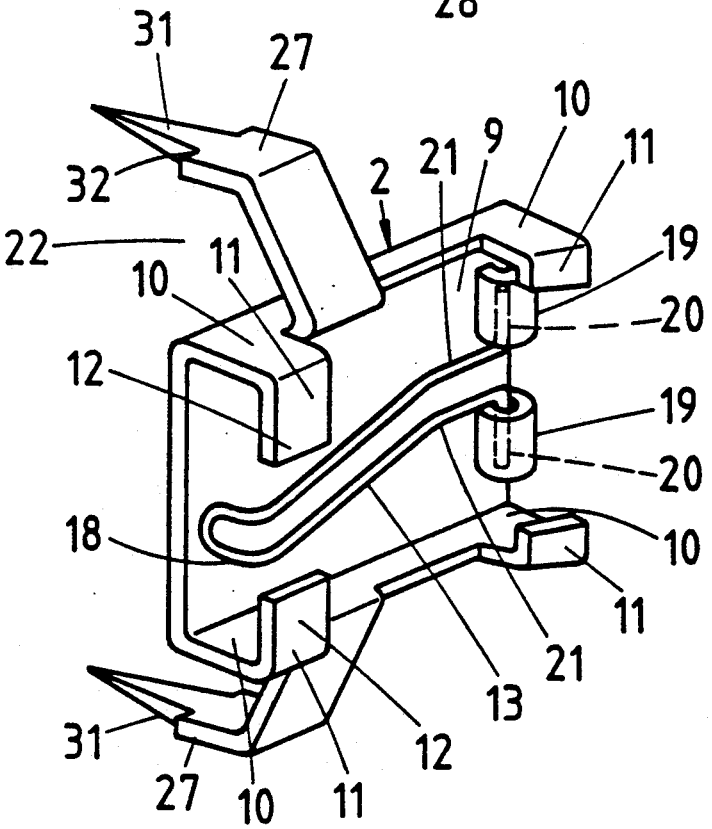
FIG.11

WAISTBAND FASTENER

This invention relates to a waistband fastener, in particular for trousers, skirts or the like.

BACKGROUND OF THE INVENTION

A waistband fastener of the type which comprises a latch rail fixed to one portion of the waistband and on which latch rail a slider or carriage connected to the other portion of the waistband is guided in an adjustable and latchable manner, in such a way that a latch finger engaging between the teeth of the latch rail is provided for the slider, is known from U.S. Pat. No. 4,180,891. There, a lever hinged to the slider effects the engagement of the latch finger. The hinged lever has two arms, one of which serves as an operating grip and the other of which continues or merges into the latch finger which directly engages with the latch gaps or recesses of the latch rail. Although in that construction the disposition of the hinge axis very close to the rail is achieved, relative movements between the latch rail and the slider result due to the pivoting motion of the hinged lever. Moreover, a rather high pressure application is required. For example, if the tooth gaps are not positioned, with regard to the latch finger, in such a way that the latter can be pivoted therein, the teeth can be damaged. Furthermore, the high space requirement for the swung-out position of the hinged lever is deemed to be a disadvantage, as well as the risk of an undesired opening due to accidental contacts with the hinged lever, which risk cannot be completely excluded. Additionally, the manufacture of such a waistband fastener is relatively expensive.

BRIEF DESCRIPTION OF THE INVENTION

It is an object of the present invention to provide a waistband fastener of this kind which has a simpler construction and is both less expensive to manufacture and easier to use.

Generally speaking, due to the construction according to the present invention, a waistband fastener having an enhanced utility as well as an essentially simplified structure is achieved; thus, the slider itself is, at the same time, the operating means or handle of the fastener. The adjusting or latching takes place nearly exclusively in the longitudinal plane of the functional slider/latch rail components; transversely thereto there is practically no space requirement, since the usual hinged lever, which generally neccessitates high space volume for pivoting it, is dispensed with. Such a waistband fastener can, moreover, be constructed extremely flat, inasmuch as a deviation out of the longitudinal direction takes place, at most, to the extent of the depth of a tooth gap, i.e., approximately 1–2 mm.

Concretely, the arrangment is such that the latch finger can be brought out of engagement with and fully clear of the sawteeth of the latch rail by shifting the slider transversely to the latch rail so that the sawteeth can be completely skipped by the slider when the latter is moving along the latch rail in one direction. Therefore, the actuation required in order to enlarge the width of the waistband is limited to a simple directed exertion of pressure onto the slider, namely, transversely to the longitudinal direction of the latch rail, and a subsequent shifting of the slider.

An optimal version of the so-called push/pull system is thus achieved. Intermediate parts such as the hinged lever and its bearing means are rendered superfluous. The movement in the opposite direction, i.e., the shifting of the slider in the sense of a reduction of the width of the waistband, can be simply effected by a pulling at the slider, by means of which the sloping backs of the sawteeth are freely overrun by the latch finger. Moreover, an advantageous solution is provided by means of a spring of the slider, which spring acts upon the backside of the latch rail and serves for pressing the latch finger into the tooth gaps of the latch rail. On the one hand, this spring effects the functionally correct tooth engagement, whereas, on the other hand, the spring force can be overcome by a deliberate transverse shifting of the slider in order to bring the latch finger out of engagement with the teeth.

Another advantage is that since the sawtooth structure is arranged at the side of the fastener facing the article of clothing, the relatively intense frictional stressing of the clothes resting on it, for example, of the jacket, is eliminated, so that the covering strip which otherwise would be provided to overlie the teeth ripples and afford a protective effect in this respect, could even be omitted. Such a covering strip is provided in the above mentioned prior art citation. Therefore, the covering strip now has, at most, a function to improve the appearance of the article of clothing.

A further advantage of the present invention is due to the fact that the latch rail comprises a foot extending longitudinally in the middle region of the rail, and the two lateral portions of the latch rail which freely extend from the bottom mounting plane of the latter and comprise the sawtooth structure are overlapped or encompassed by respective U-shaped legs of the slider. As a whole, therefore, a slider with a generally C-shaped cross-sectional profile is provided, the middle part or web of which forms the bottom of the slider which continues or goes over into the C-legs in order to finally continue or go over into the C-like angular portions directed toward each other. An optimal guiding in this respect results by means of paired sets of legs of the slider which are offset or spaced from each other in the direction of movement of the slider. Appropriately, the legs are provided at the ends of the slider.

The arrangement thus is such that the latch fingers are constituted by means of prolongated ends of the legs extending beyond the lateral regions of the guiding portions. Practically, in consideration of the orientation of the sloping sawtooth backs, the latch fingers are correspondingly obliquely oriented. Furthermore, the latch rail has a groove for sewing, which groove is provided at the backside overlying the foot of the latch rail and thus reduces the material agglomeration of such a foot; the latch rail can, therefore, be sewed on more easily and, especially, also faster.

As regards the spring which urges the slider into the latching position, this is suitably constituted by a tongue of the slider bottom extending in the longitudinal direction of the slider. Such a free-cut tongue can be given the desired bias force by bending it outwardly. Another possibility resides in that the tongue is formed as a buckle spring hinged at one end. With reference to the desired intentional, i.e., defined, tilting of the slider on the latch rail, the root or bottom portion of the spring is provided in opposed position with regard to those portions of the legs which act in a merely guiding manner. The free distance between this root or bottom portion of the spring and the corresponding inner flank or side of the guiding portion can be adapted to the thickness of the lateral area of the latch rail, so that the tilting or pivoting caused by the spring is restricted to the other end of the slider where the latch finger or pair of fingers is provided.

In order to optimize the sliding conditions, it is furthermore proposed to provide, in the root or bottom portion of the spring, a convex surface which extends along the whole transverse width of the slider and is directed toward the backside of the latch rail. In contrast thereto, the free end of the spring tongue is arranged in opposite position to the latch fingers. Moreover, an advantageous implementation resides in that the width of the spring tongue is greater than the width of the sewing-on groove Of the latch rail. In this manner, a relatively large guiding width is used for the sliding of the spring tongue.

In order to attach the fastener mechanism to the article of clothing so as to be out of sight, the slider leaves open or free a passageway or tunnel for a covering strip for the latch rail. The covering strip is transversely sewed onto the waistband before the ends of the latch rail. The passageway or tunnel forms, at the same time, an advantageous guiding support for the covering strip. Furthermore, it is structurally and location-wise of advantage, in this connection, when the passageway or tunnel is formed by feet projecting rearwardly from the slider bottom, with the ends of the feet continuing or going over into angularly extending cramp-fixing legs. The beam-like feet form the corresponding spacing means and also provide a surface stiffening for the slider bottom.

A solution which is especially suitable in this connection as regards the attachment or setting-on, is provided by the feature that the sets of feet projecting at the backside of the slider, i.e., being bent in the direction of the outer waistband, form a cramp-deviation or deflection channel. Such a cramp-deviation channel renders a special abutment superfluous; the deviation-abutment is directly realized at the slider itself. An implementation which is structurally advantageous results from the fact that each deviation channel for a cramp spike is formed by a folding back of a portion or first region of the foot adjacent an insertion opening and by a folding of a free end portion or second region of the foot under the proximate edge portion of the slider bottom. In this regard, one advantageously starts with a channel length which enables a complete covering or disappearance of the tapered or pointed cramp spike. This is of advantage on optical or visual grounds as well as with regard to its usability, since no free-standing tips are present which could lead to damage of the cloth.

In order to avoid any deviational movement of the cramp spike even with large cloth thicknesses, the arrangement is, moreover, such that the folded-back portion and the folded-under portion of each foot define a guiding thickness at the inner side. This can be additionally taken into account at the punching-out of the slider, which is most suitably formed from a folded blank, by means of a corresponding stamping or deformation. The so-formed bead has, at the same time, a stiffening effect which is especially of importance for an abutment to be formed at the slider itself. Therefore, even the customary material with thin walls can be used.

In order to further enhance an easy, in particular hooking-free folding of the cramp spike, the inner vertex between the folded-back portion and the folded-under portion of each foot extends in a concave arc. It is further proposed that the free section of the cramp deviation channel tapers toward the inner end. Herewith, even the resetting spring force of the corresponding parts of the deviation channel can be used for an effective deviation loading of the cramp spike. In order to provide an input portion for the deviation channel with a cross-section as large as possible, despite this clamping force acting first in the end phase, the invention furthermore contemplates that the tapering continues, i.e., that the channel narrows, until below the corresponding thickness dimension of the cramp spike and that the channel zone lying in front of it and the insertion opening comprise a greater free cross-section of approximately two times the thickness dimension of the cramp spike.

As regards the entrance region, it can prove to be of advantage that the portion of the foot which defines the passageway or tunnel, as well as the folded-back portion, run essentially parallel to each other and that the folded-under portion is rectangularly bent inwardly. Alternatively, under maintenance of the wall profile, the arrangement can also be such that the folded-back portion runs at an acute angle with respect to the foot portion and practically touches, with its bead-free portion of the inner surface, the foot/slider bottom edge region. By means of this feature, a continuous insertion of the cramp spikes is effected already at the beginning, which cramp spikes in the end phase then move, in an advantageous embodiment, at an acute angle against the folded-under portion directed toward the slider bottom and are in hook-like manner deviated or even curled or bent round.

BRIEF DESCRIPTION OF THE DRAWINGS

The present invention is described in more detail hereinafter with reference to two embodiments thereof illustrated in the drawings, in which:

FIG. 9 shows a modification of the slider, in perspective view;

FIG. 10 shows the associated cramp or staple, likewise in perspective view;

FIG. 11 shows a further modification of the slider containing a buckle spring, likewise in perspective view;

DETAILED DESCRIPTION OF THE INVENTION

Figure 1:
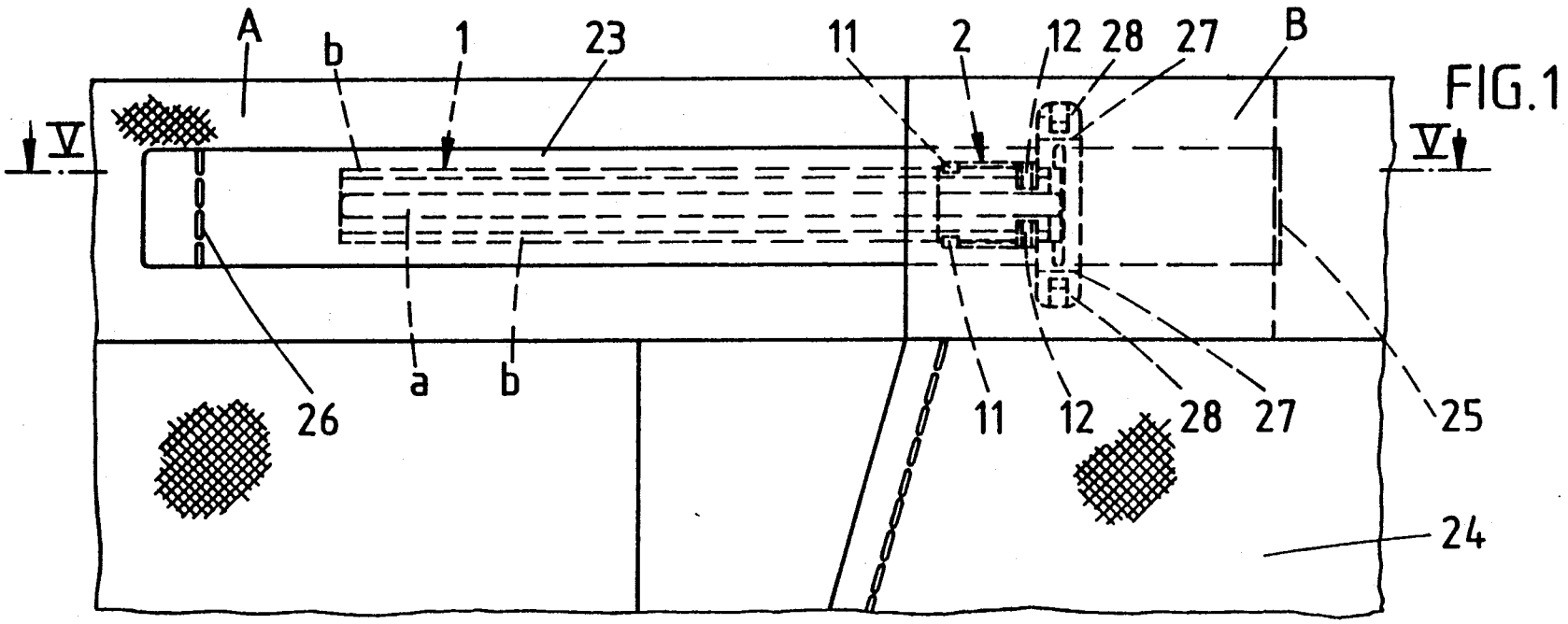
FIG. 1 shows a waistband fastener, according to a first embodiment of the invention, for a pair of trousers, the fastener being illustrated in side view and in approximately natural size.
Figure 2:
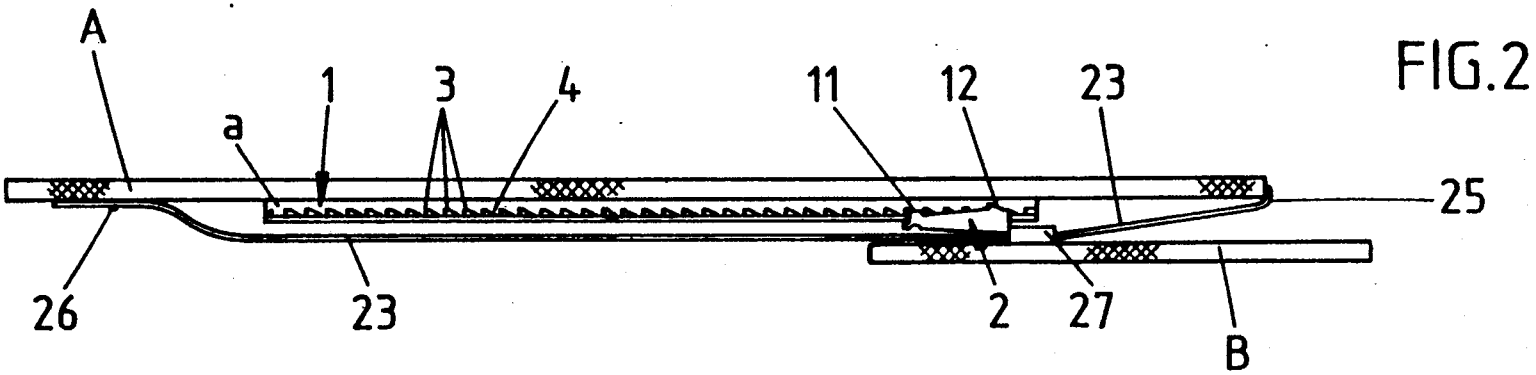
FIG. 2 a top view of the fastener but without any illustration of the curvature thereof.
Figure 4:
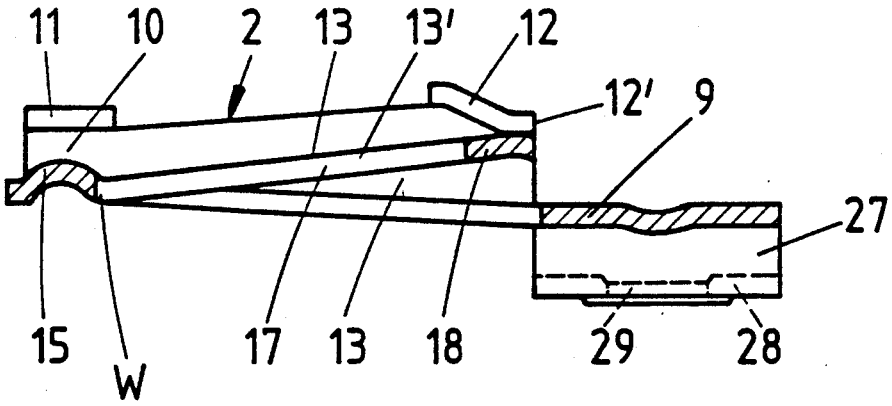
FIG. 4 shows a section taken along the line IV—IV in FIG. 3.

Referring now to the drawings in greater detail, FIGS. 1 and 2 show the waistband fastener according to one embodiment of the present invention, which is longitudinally displaceably guided along a latch rail 1, as including a slider or carriage 2. The latter is adjustably and latchably guided on the latch rail 1 which comprises a regular or uniform sawtooth structure having sawteeth 3 (see also FIG. 5). The gaps between the teeth are denoted by reference numeral 4. The movement-blocking steep tooth flanks 3' extend vertically with respect to the longitudinal direction of the rail. The tooth backs 3'', in contrast thereto, are oriented at an acute angle to the longitudinal direction of the rail. The tooth tips 3''' are truncated. The ratio between the length of the steep tooth flank 3' and that of the sloping tooth back 3'' is approximately 1:2.

The latch rail 1 is made of plastics material, for example, polyethylene, and has a roughly V-shaped symmetrical section, with a middle region a and two side portions b, and is dominated by a centrally running sewing-on groove 5 (FIG. 7) which is open at the side of the rail facing the slider 2. The sewing-on groove forms, in opposite direction, a foot 6. The sidewardly projecting portions b of the wing-like rail profile are joined by the longitudinal middle region a and are significantly spaced, due to the presence of the foot 6, from the mounting surface 7 of an inner waistband part A. The seam fixing the latch rail 1 to the waistband part A is denoted by the reference numeral 8.

Figure 7:
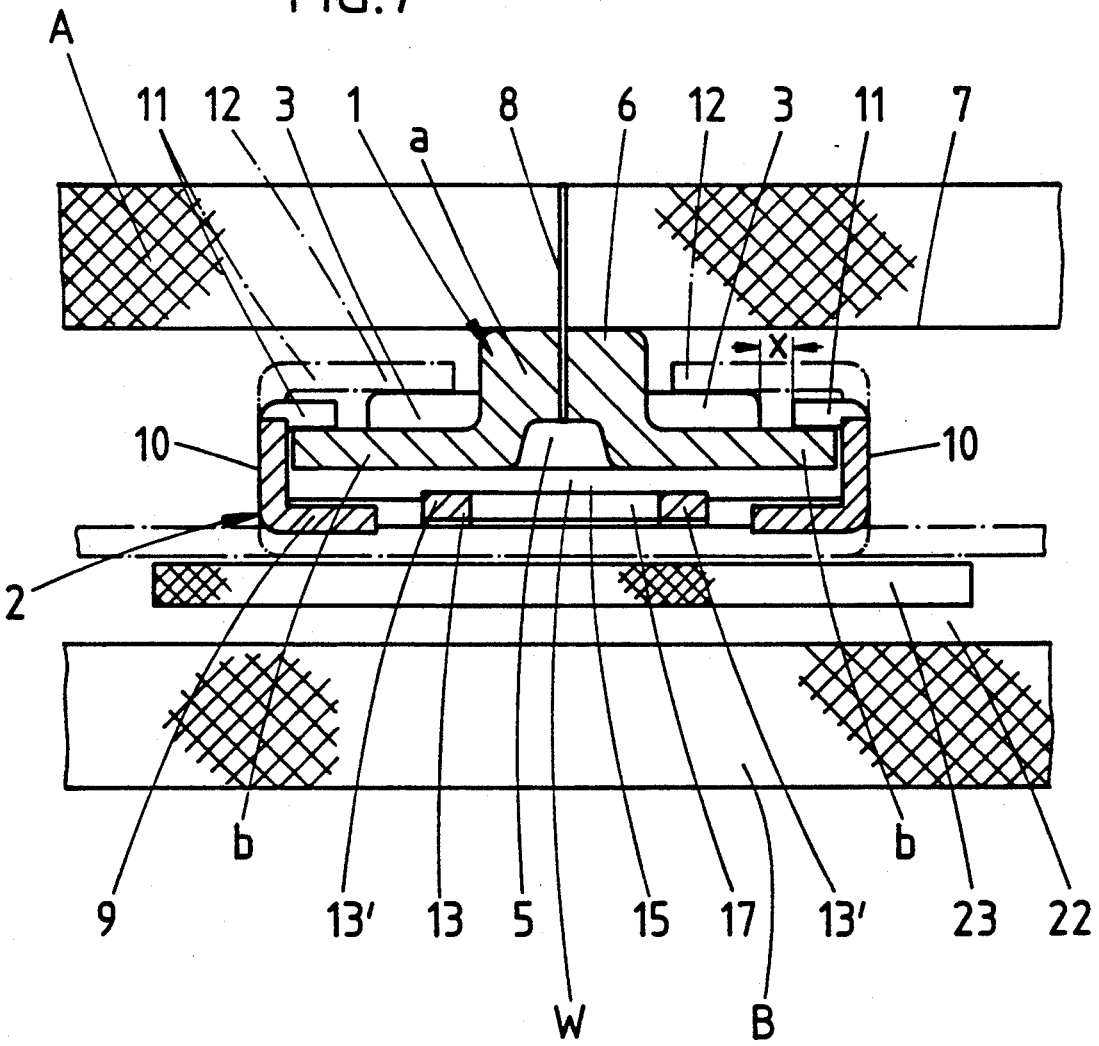
FIG. 7 shows a section taken along the line VII—VII in FIG. 5.
Figure 12:
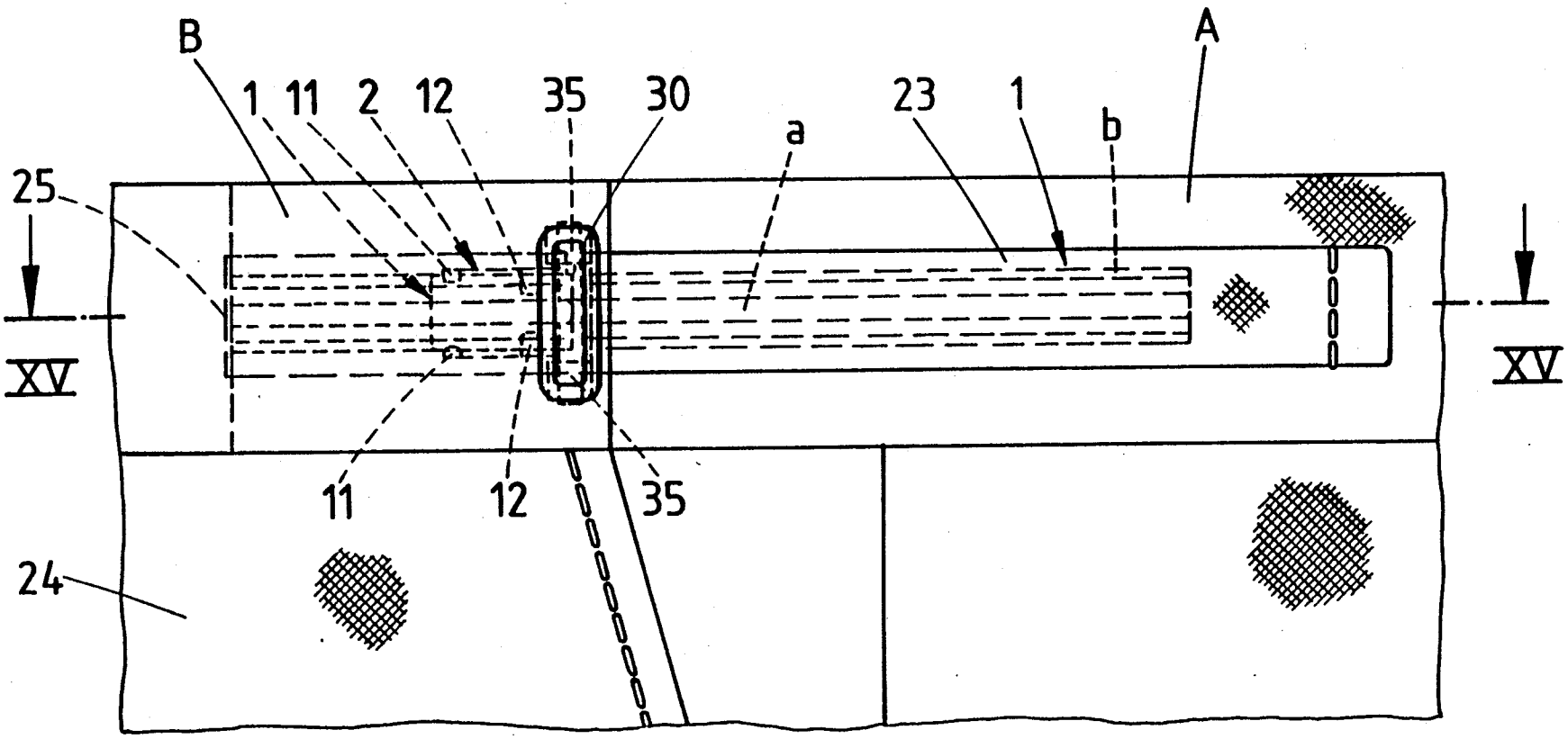
FIG. 12 shows a second embodiment of the waistband fastener according to the invention, the fastener being illustrated in side view, on a pair of trousers in approximately natural size.
Figure 14:
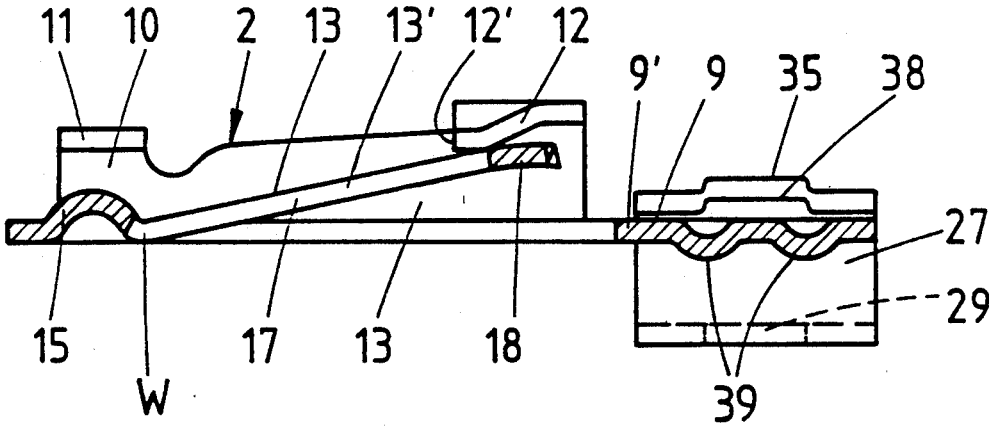
FIG. 14 shows a section taken along the line XIV—XIV in FIG. 13.
Figure 13:
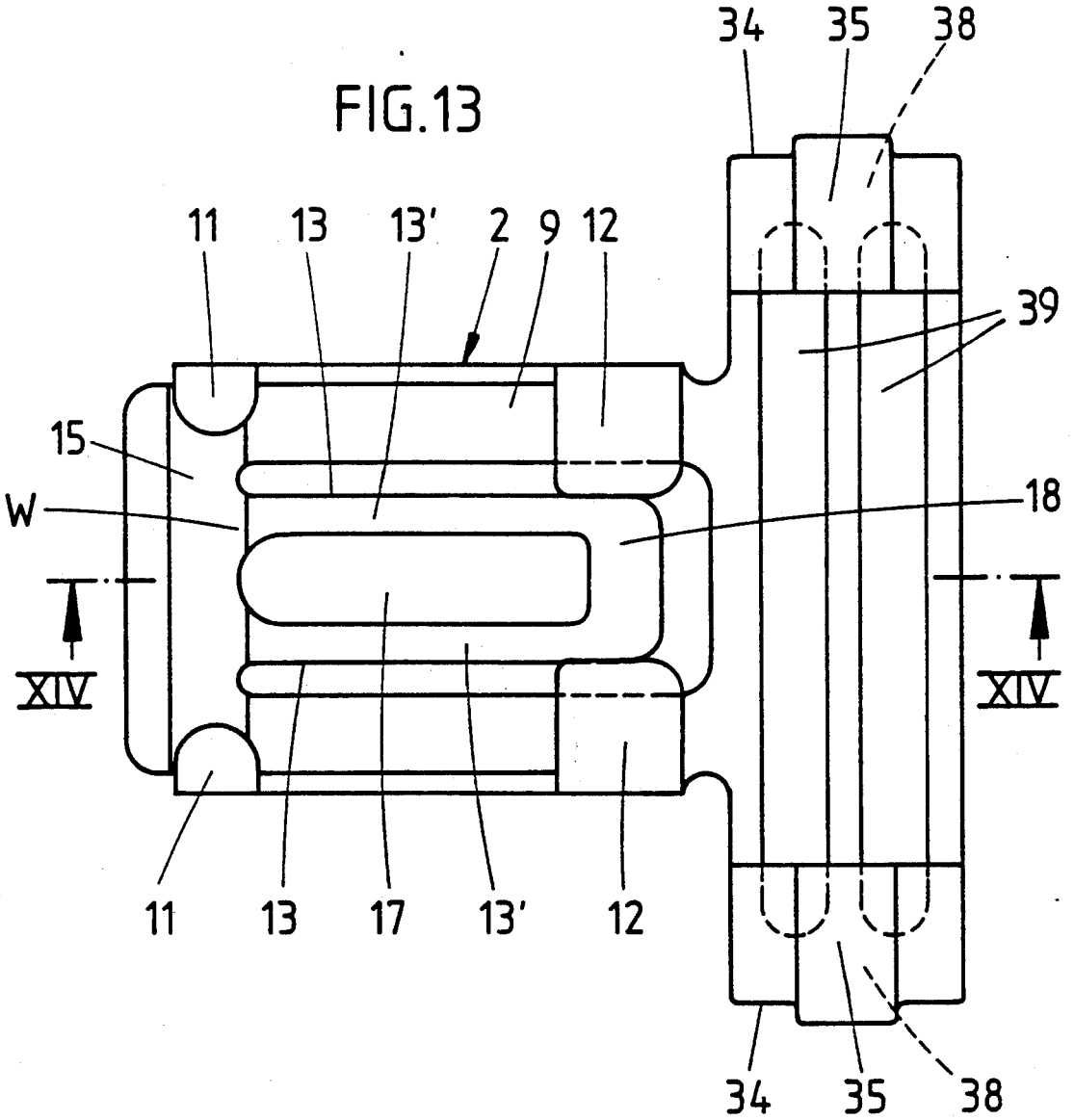
FIG. 13 shows a top view of the slider of the fastener of FIG. 12, in isolated representation.
Figure 15:
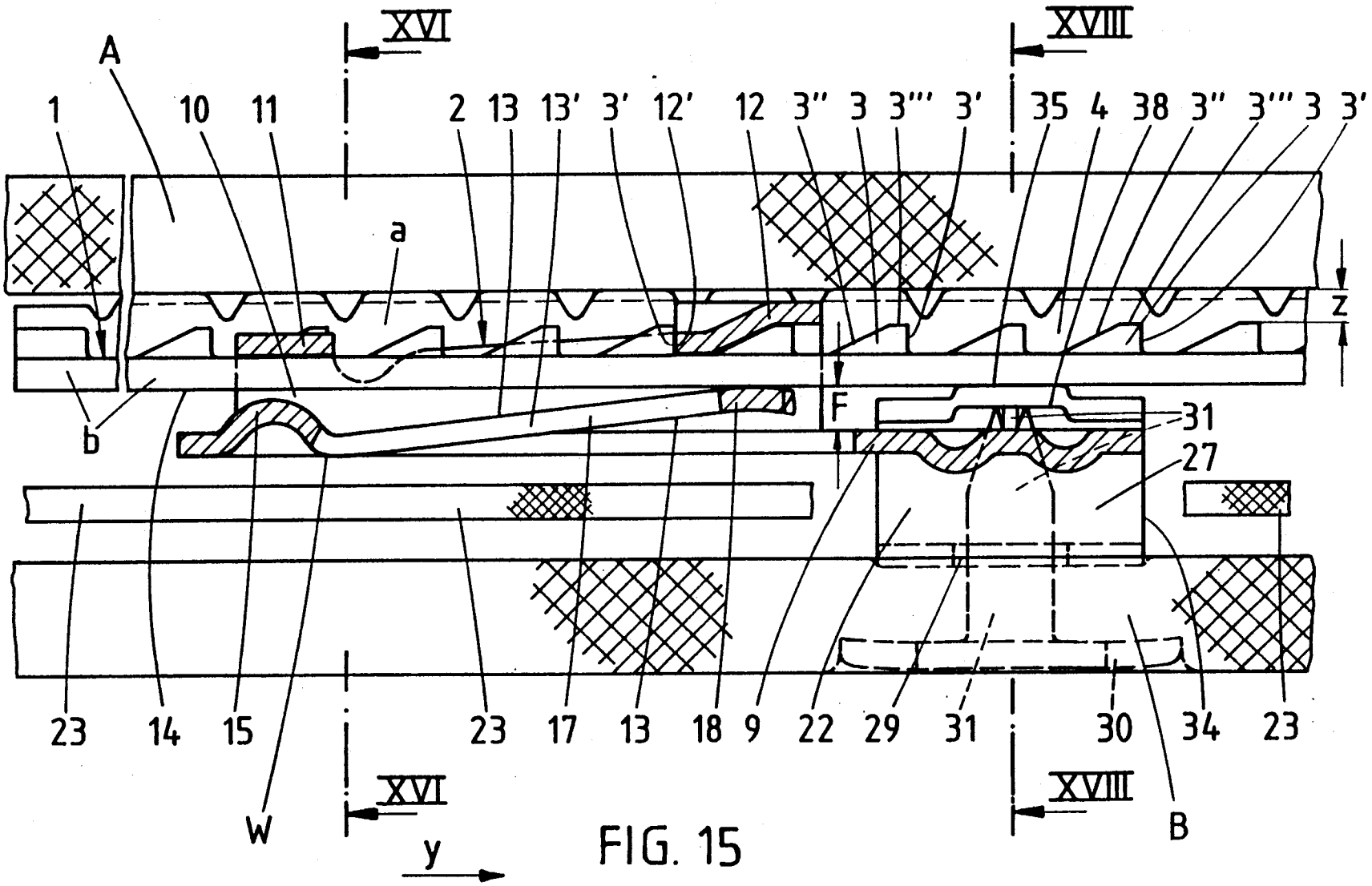
FIG. 15 shows a section taken along the line XV—XV in FIG. 12 and illustrates the latched position of the fastener, the latch rail itself not being represented in section.

The lateral portions b of the rail carry, on the side thereof facing the mounting surface 7, the described sawtooth structure. As viewed in the direction of orientation of the lateral portions b away from each other, i.e., cross-sectionally, the pair-wise arranged rows of sawteeth 3 cover approximately half of the length of these portions (FIG. 7). Apart from the latching function, the sawteeth 3 have the additional function of stabilizing the change-over region between the longitudinal middle portion a forming the foot 6, and the lateral portions b.

As can be seen especially clearly in FIG. 7, the slider 2 being guided along the latch rail 1 has a generally C-profile, when seen in section, which C-profile overgrips or surrounds the edge zones of the rail body in a U-like manner. The bottom 9 of the slider 2 is formed by the bridge or web portion of the C-profile and continues, at both ends of the bridge, in the form of legs 10 overlapping or covering the edges of the rail portions b. The legs 10 are rectangularly bent and go over into the form of inwardly directed guiding portions 11. The guiding portions 11 are so dimensioned, in overlapping the edge portions b, that they end at a distance from the tooth structure, i.e. the respective lines of sawteeth 3. These guiding portions 11 are also to be seen at the left side in FIGS. 5 and 6.

Figure 5:
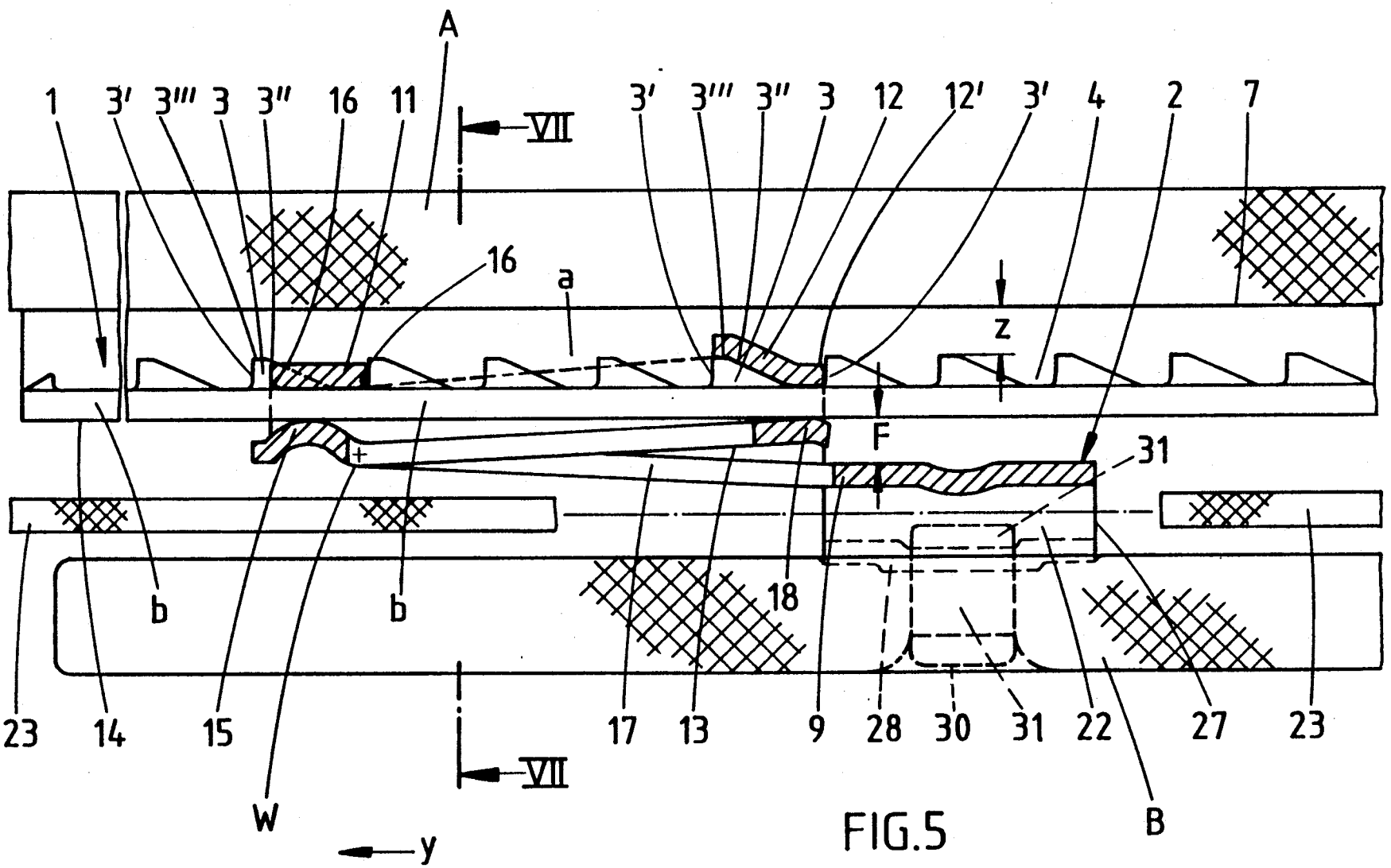
FIG. 5 shows a section taken approximately along the line V—V in FIG. 1 and illustrates the latched position, the latch rail itself not being represented in section.
Figure 6:
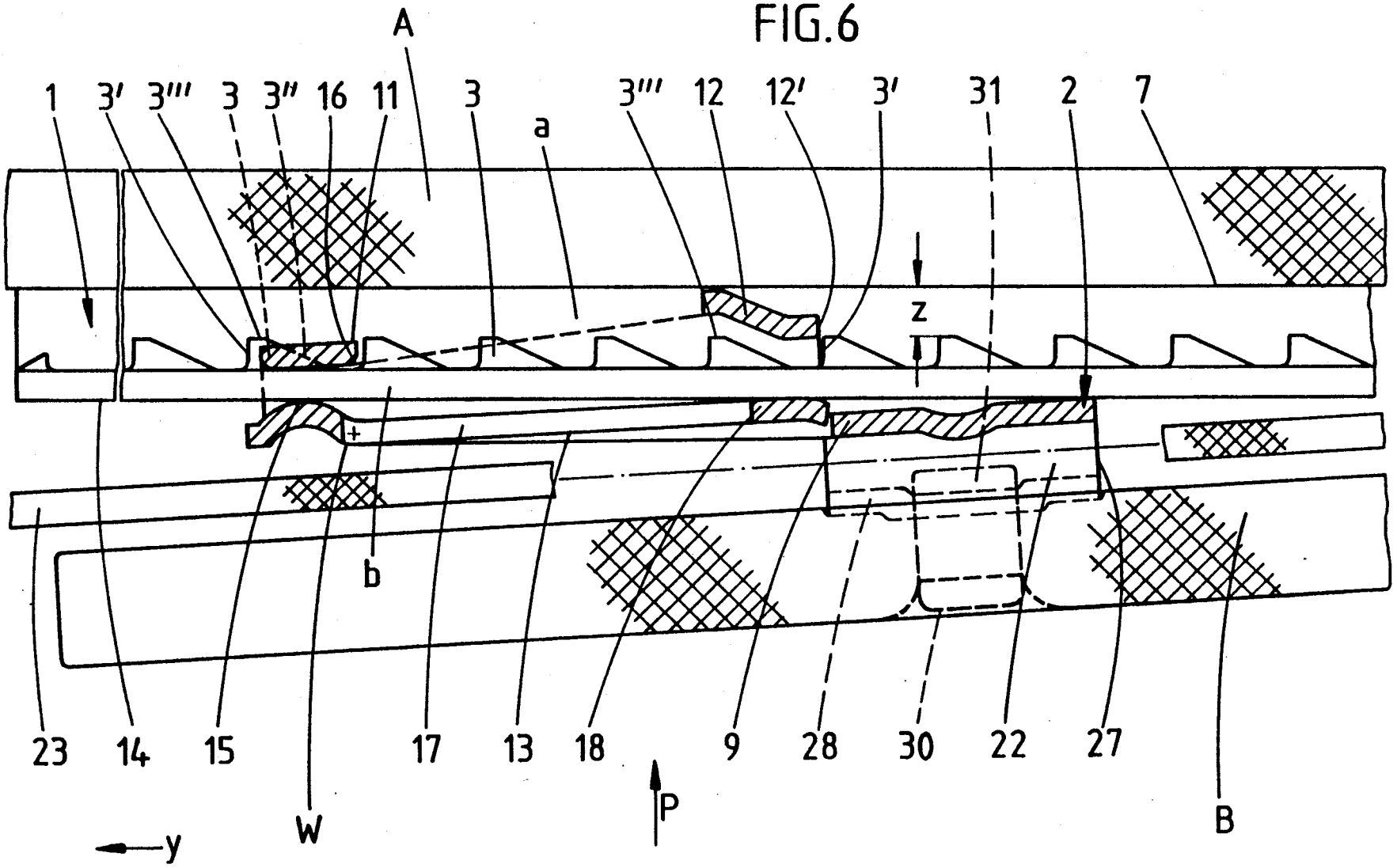
FIG. 6 shows a sectional view similar to FIG. 5 but illustrates the out-of-engagement position.
Figure 8:
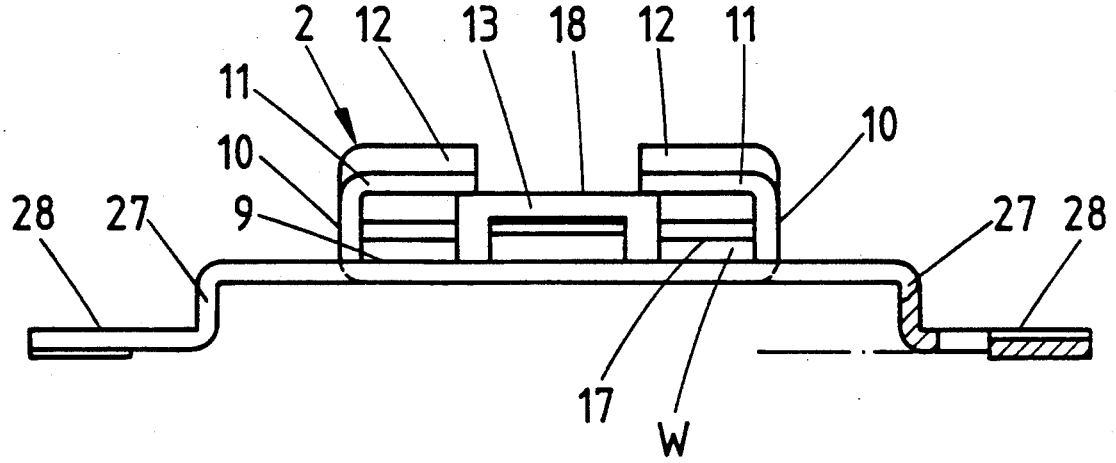
FIG. 8 shows the slider in isolated representation, as seen from the front end at the tunnel side.

The guiding portions lying at the right side in FIGS. 5 and 6 continue beyond the extent of the other guiding portions so that they form, with their prolongated ends, respective latch fingers 12. The latch fingers 12, or more particularly the guiding portions forming units thereof, are obliquely oriented in adaption to the sloping tooth backs 3'' and have a corresponding contour. The oblique contour is arranged at the middle region of each latch finger. In contrast thereto, the end of each latch finger 12 which faces the bottom side of the associated lateral portion b, runs in parallel to the longitudinal extent of the latch rail 1. The same applies with respect to the free end of each latch finger 12, namely, the higher end of the latch finger, which is oriented towards the plane of the underlying truncated tooth tips 3'''. The end flank 12' at the right side of each latch finger 12 coacts, in a blocking manner, with the corresponding steep tooth flank 3' of the sawteeth 3. The ends of the latch fingers 12 which are directed towards each other, terminate short of the longitudinal small sides of the foot 6 and at a clear spacing therefrom (see FIG. 7).

The slider 2 is spring-loaded (see FIGS. 3–11) in the direction of engagement of the latch fingers with the teeth 3. Its spring, which is designated 13, is arranged at the slider bottom 9. The spring 13 bears against the back side 14 of the latch rail 1 (FIGS. 5 and 6) and thereby brings the latch fingers 12 into engagement with the tooth gaps 4 at that portion, as can be seen from FIG. 5. When in this position, the slider 2, which is fixedly connected with the waistband part B overlying the waistband part A located nearer to the wearer's body, can be shifted freely in the direction of the arrow y, because the latch fingers 12 freely overrun the sawteeth in a ratchet-like manner. This movement, of course, is in the direction of a reduction of the waistband width.

If it is desired, in contrast thereto, to enlarge the waistband width, it is necessary to deliberately exert a pressure force, onto either the slider 2 or the waistband part B holding it, in the direction of the arrow P (see FIG. 6). In this way, the out-of-engagement position shown in FIG. 6 is achieved, in which the slider 2 can be moved counter to the direction of the arrow y. Such a transverse shifting of the slider 2 is possible because use is made of a free space F available in the direction P, which free space F corresponds at least to the depth of engagement, i.e., the height, of the sawteeth 3. Moreover, a free deflection space z is provided above the blunt or truncated tooth tips of the sawteeth, which space z corresponds at least to the total height of the obliquely oriented latch finger 12 With respect to the mounting surface 7.

The guiding portions 11 at the left side end of the slider 2 (FIG. 5) do not provide a corresponding free space F; rather, at that location there is provided a narrow guiding contact which is adapted to the thickness of the lateral rail portions b. There also lies the root region W of the spring 13, which spring extends in the guiding direction of the slider 2. A positive effect with respect to the sliding is provided in that the root region W of the spring 13 has a convex surface 15 extending along the total transverse width of the slider 2. The convex surface 15, which is oriented toward the back side 14 of the latch rail 1, is simply formed by impressing a transverse bead into that part of the wedge-shaped slider 2.

The sliding function and even the tilting function is furthermore enhanced by a construction of the guiding portions 11 at that location insofar as the sliding surface facing the lateral portions b is broken at both ends. The corresponding socket or holder 16 can be seen in FIG. 5.

Figure 3:
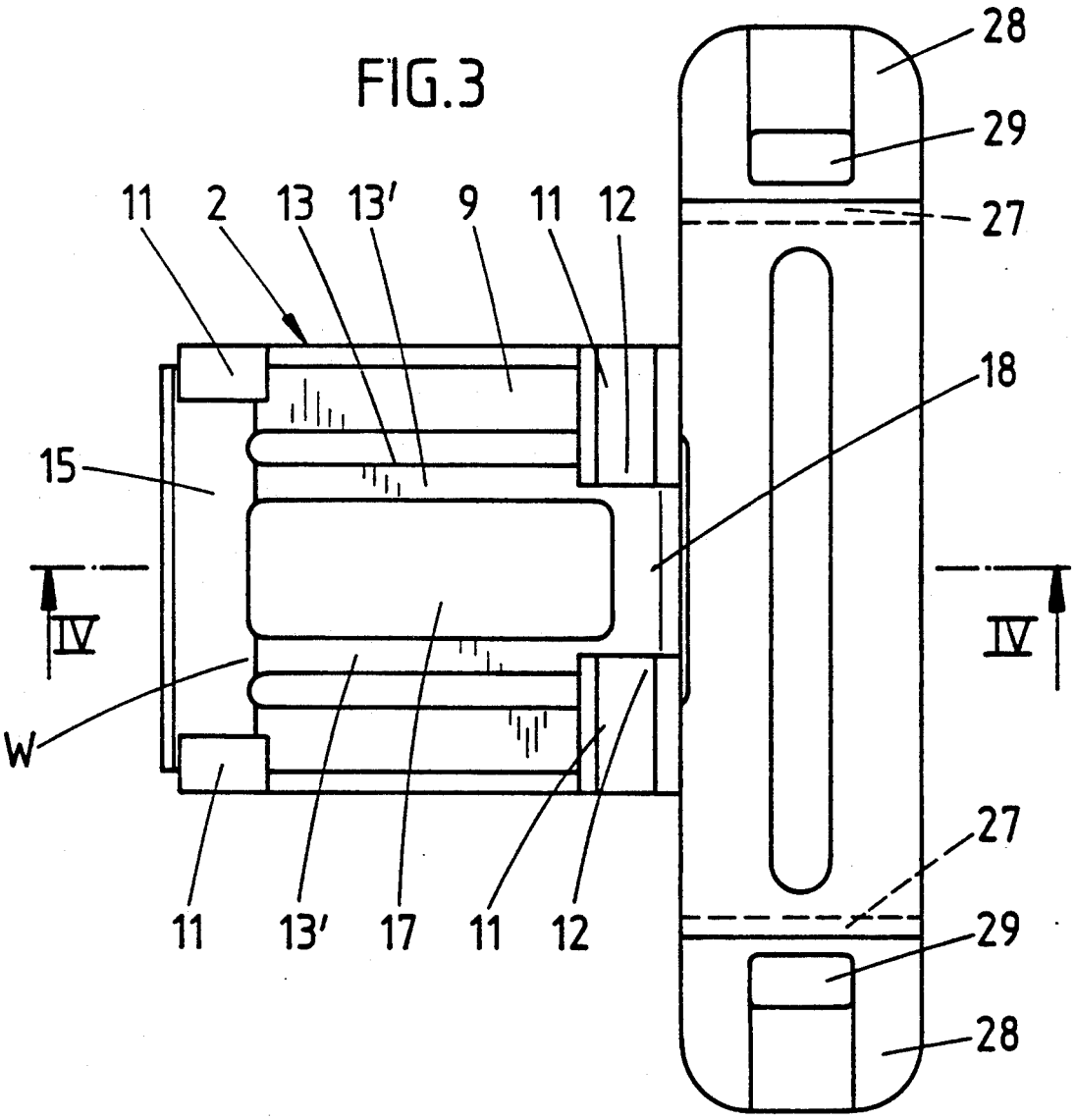
FIG. 3 shows a top view of the slider in isolated representation.

The width of the spring 13 which, according to FIGS. 3 and 7, is formed by free-cut tabs or straps of the slider bottom 9, is so selected that the spring 13 does not penetrate into the sewing-on groove 5, but is guided at the smooth remaining width of the backside 14 of the latch rail 1. The sewing-on groove 5 extends along the latch rail foot 6 and occupies only a part of the width of the latter (see FIG. 7).

As shown in FIG. 3, the spring 13, which, as previously stated, is constituted by a longitudinally running tongue of the slider bottom 9, additionally is provided with a windowlike opening 17. By virtue of the presence of the latter, the tongue has two relatively small spring legs 13' and a transverse web 18 lying at the free end of the spring 13 which constitutes the spring head. In order to enhance its slidability, the web 18 is transversely rounded, but at least is chamfered at the rail-side transverse edges thereof.

In the modification according to FIG. 9, even a clear curling or rolling-round of the spring head 18 can be seen. Here, a central tongue is provided as the spring 13 which is laterally accompanied by a pair of curlings or loops 19 ending in the root region W of the spring 13. The lateral bent-round parts 19 in this case assume the above-described function of the root region W. Taking into account the tilting shifting of the slider 2 in this region, the guiding portions 11 are obliquely oriented, in order to afford the free movement necessary for the tilting motion. The divergence with respect to the plane of the slider bottom 9 lies in the direction of the slider end at that location.

The modification according to FIG. 11 uses a different type of spring construction, wherein a buckle spring formed of suitably bent wire is used as spring 13. The buckle spring is U-like in shape and is provided, at the root side, with axle-like transverse portions 20 which are received and positioned in bent-round parts 19 provided on the slider at that location. The axial length of the outwardly oriented axle portions 20 is such that a plug-in mounting at the inner side of the slider bottom 9, using the free space between the two bent-round parts or journals 19, is possible. The free end of the spring 13 again comprises a convex configuration in the sense of the construction of the spring head 18 of the described kind. The bias-generating offset of the spring 13 results from a bend 21 provided in the region of the spring near the anchored end of the same.

In order to generate the bias force of the spring 13 in each of the described variants thereof and to achieve the functional capability as a whole, it will be understood that sufficient free space is provided between the legs 10 or between the guiding portions 11, as the case may be.

Reverting now to FIG. 9, the slider 2 there shown is provided with a passageway or tunnel 22 in the back of the slider 2, between the slider and the waistband B carrying the same. The passageway 22 permits the insertion of a latch rail cover strip 23 (FIGS. 1 and 2) which extends over the latch rail while keeping the same hidden from view. When mounting the waistband fastener on the garment, the cover strip 23 is sewed at both ends thereof onto the waistband part A (the part which lies nearer to the wearer's body) at locations spaced from the ends of the latch rail 1. That end zone of the cover strip 23 which is not additionally covered by a trousers turn-up or cuff 24 is secured to the waistband part A by stitching 25, while the other end zone of the strip (shown to the left of the latch rail in FIG. 1) is secured in place by stitching 26.

The passageway or tunnel 22 is formed by feet 27 starting from the slider bottom 9 and projecting in the direction of the outer waistband part B. The feet 27 terminate in respective right-angle bent laterally outwardly directed sections 28 constituting a pair of cramp-anchoring legs. In essence, the latter constitute a pair of eyelet-like extensions having openings 29. The associated U-shaped cramp or staple element 30 is shown in FIG. 10 and has transversely extending legs which are tapered to form cramp tongues or spikes 31, which when inserted through the openings 29 are bent over at the back sides of the anchor legs 28. Instead of a continuous tapering of the cramp spikes or tongues 31, a tapering merely at the extremities thereof is also sufficient.

The modification according to FIG. 11 differs from that of FIG. 9 in that in FIG. 11 the feet 27 are attached to the slider at each side of the latter between the respective two colateral guiding portions 11, starting from the correspondingly cut-back legs 10. At first, the feet 27 slope downwardly in a gabled roof-like manner, after which they continue as a pair of parallel legs defining therebetween the passageway or tunnel 22. A pair of cramp spikes or tongues 31, each of which at its base has a width which is smaller than that of the respective foot 27, project from the feet, so that the resultant shoulders 32 can seat fully on the mounting surface of the waistband part B. The associated backing or counter-plate, which would lie at the outside of the waistband part B, is not shown.

The operation of the waistband fastener as so far described is, briefly summarized, as follows:

In order to reduce the waistband width, the trouser pocket cuff or turn-up (waistband part B) is simply gripped and drawn in the direction of the arrow y (FIG. 5). The latch fingers 12 thereby slide over the sawtooth structure, rising along the slanted backs 3'' of the teeth and falling back again into the respective successive gaps 4 under the action of the spring 13. After the slider has been released, the latch fingers 12 remain in whatever gaps they have then reached and block any reverse movement of the slider by virtue of the end flanks 12' of the latch fingers 12 being engagement with the steep flanks 3' of the latch rail teeth 3.

If, in contrast thereto, the waistband width is to be enlarged, only a transverse shifting of the slider in the direction of the arrow P (FIG. 6), leading to a disengagement of the latch fingers from the teeth, and a subsequent longitudinal shifting movement or adjustment of the slider 2 counter to the direction of the arrow y, is required. The transverse shifting is effected against the force of the spring 13 and with a slight tilting of the slider 2 about the root region W of the spring, the same being facilitated by the convex surface 15 engaging the backside of the latch rail 1. During this tilting motion, the end flank 12' of each latch finger 12 is moved out of the then occupied gap 4 by the distance z so as to clear the steep flank 3' of the associated sawtooth 3' and the latch fingers can thus move to the right through the space above the truncated tops 3''' of the teeth 3. When the desired new position of the slider is reached, the pressure exerted thereon is relaxed and the slider 2 pivots, under the load of the spring, back into the FIG. 5 position to block further movement of the slider to the right.

The waistband fastener according to the second embodiment of the invention (FIGS. 12 to 23) has principally the same construction, as regards the latch function and the reverse movement. Like reference numerals are used in these views in the same sense as in FIGS. 1–11, albeit without unnecessary repetitions in the text. The operation direction has changed, however, as this fastener has a different, i.e. right-side, orientation of the steep tooth flanks. Thus, the refinement here resides in the different stopping function of this waistband fastener, which is a kind of stopping function that does not necessitate a special or separate deflection abutment. Such a deflection abutment is realized at the slider 2 itself.

In this respect, the arrangement is such that each of the feet 27 projecting to the back side of the slider 2, i.e., in the direction of the overlying waistband B (FIGS. 14 and 15), forms a deviation or deflection channel 33 (FIG. 17) for the associated cramp spike or tongue 31. The latter thus is no longer deviated or folded-back at the back side of the fastening legs 28. In contrast, in the embodiment according to FIGS. 12 to 23 these fastening legs 28 are made with much longer dimensions during the punching process, and these longer portions are folded back, starting from the ends of the feet 27 (and, more precisely, from the ends of the insertion openings 29), in a direction opposite to the initial orientation of the feet 27.

Figure 17:
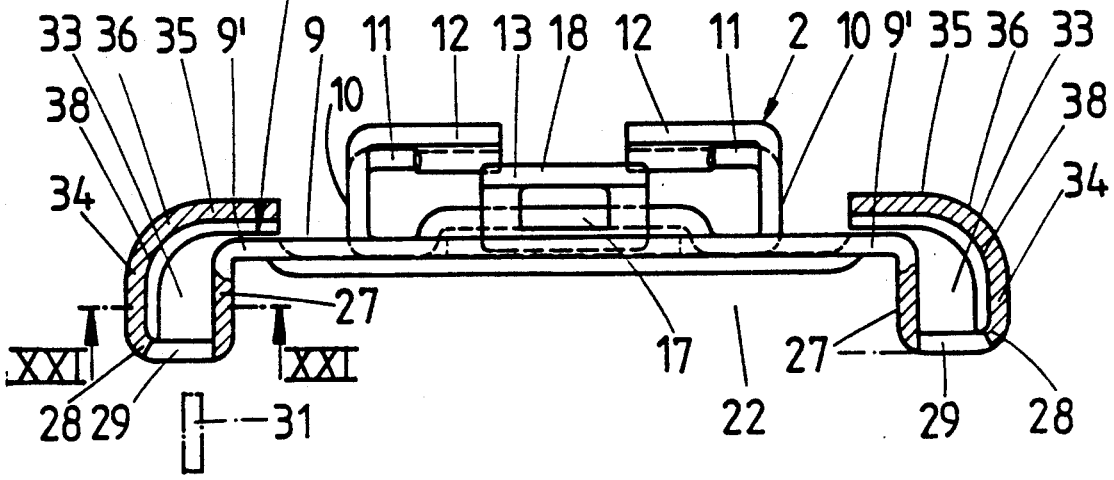
FIG. 17 shows the slider in isolated representation as seen from the front end at the tunnel side, however with the feet forming the deviation channel for the cramp spike shown in section.
Figure 16:
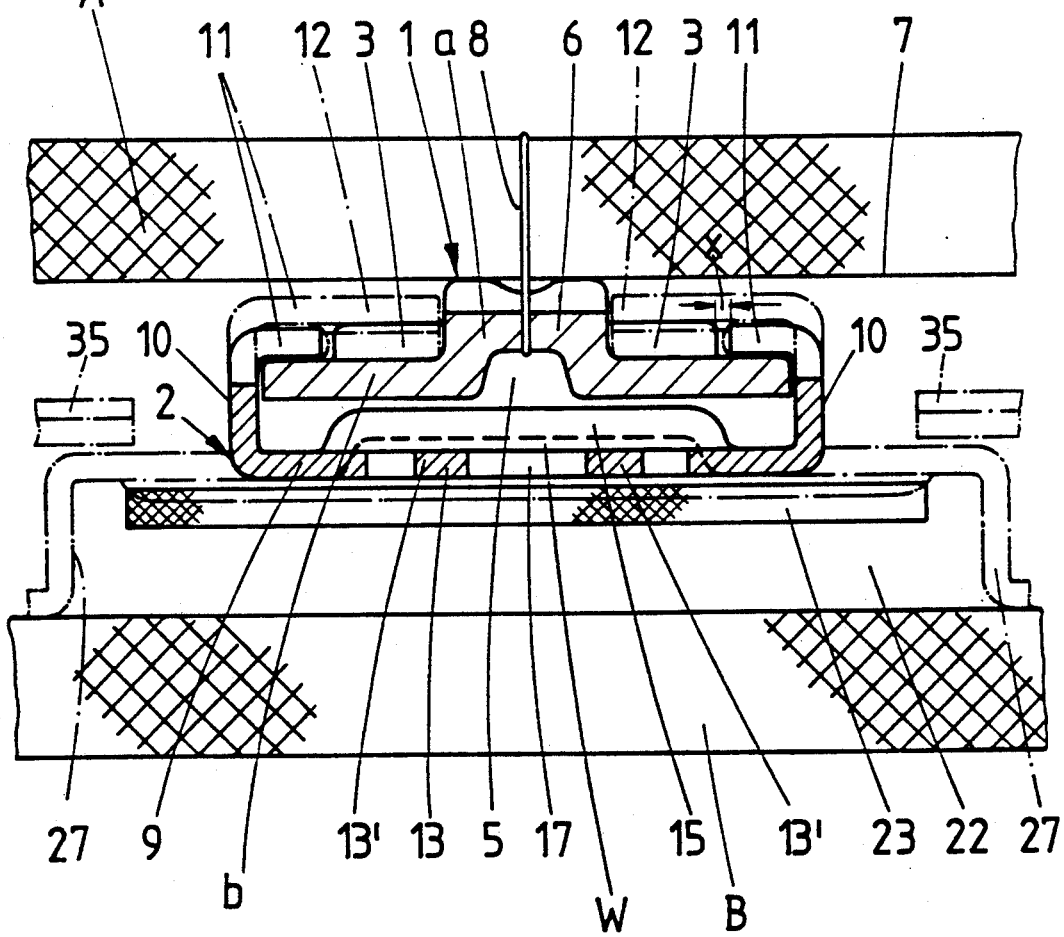
FIG. 16 shows a section taken along the line XVI—XVI in FIG. 15.
Figure 18:
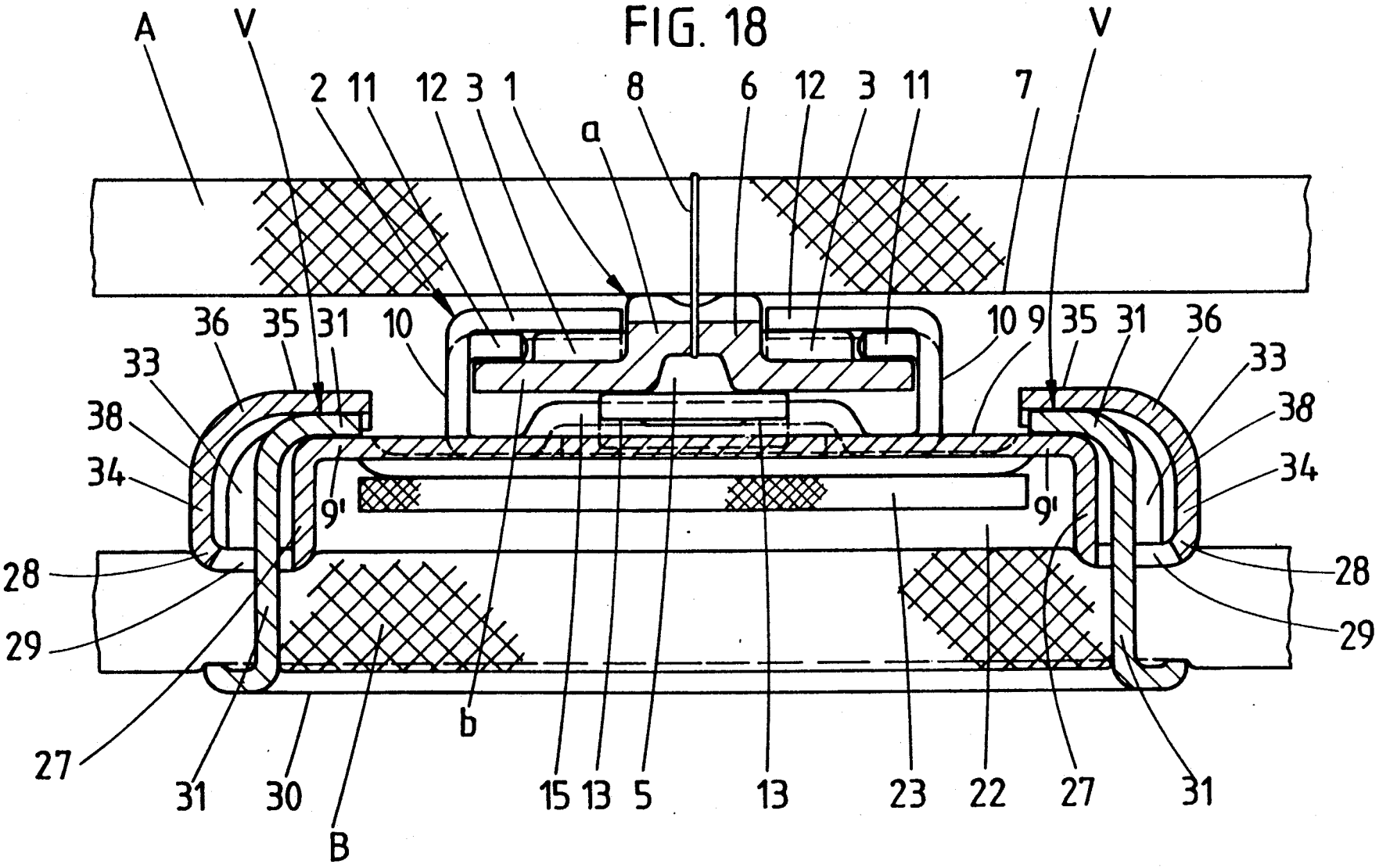
FIG. 18 shows a section taken along the line XVIII—XVIII in FIG. 15.
Figure 20:
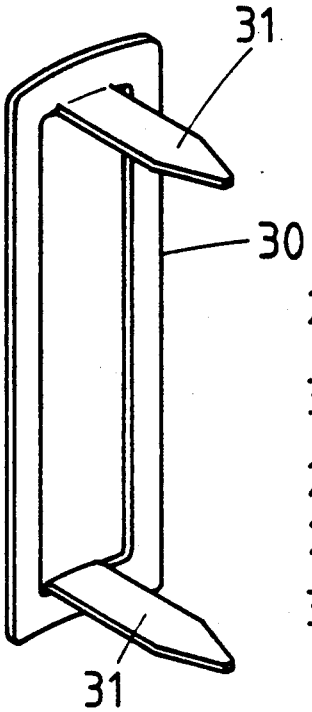
FIG. 20 shows the associated cramp or staple, likewise in perspective view.
Figure 19:
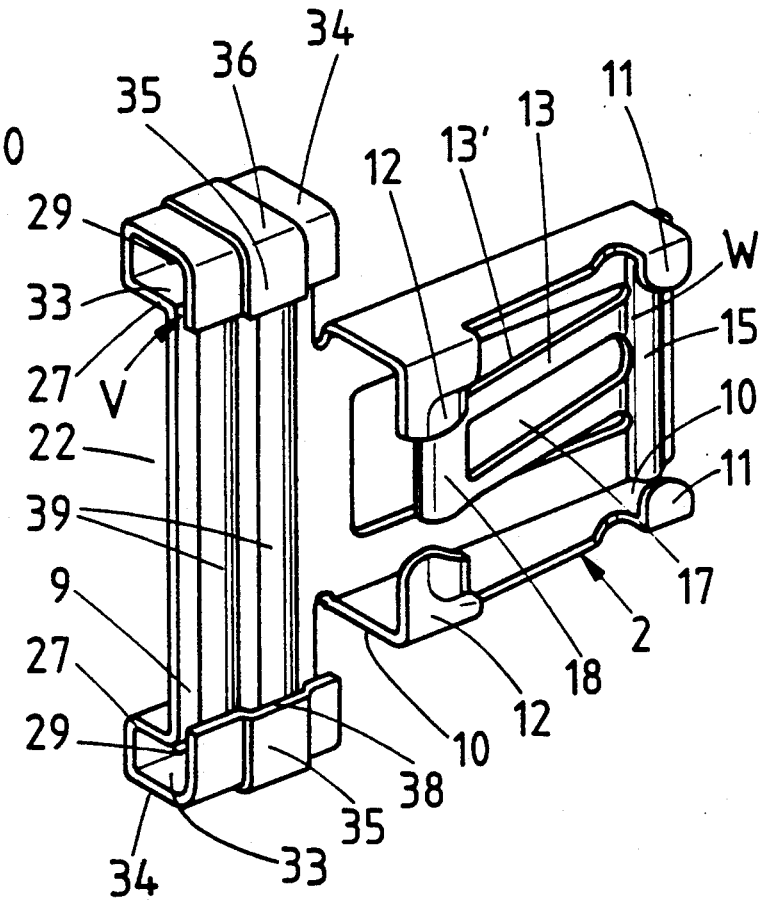
FIG. 19 shows the slider in perspective view.
Figure 21:
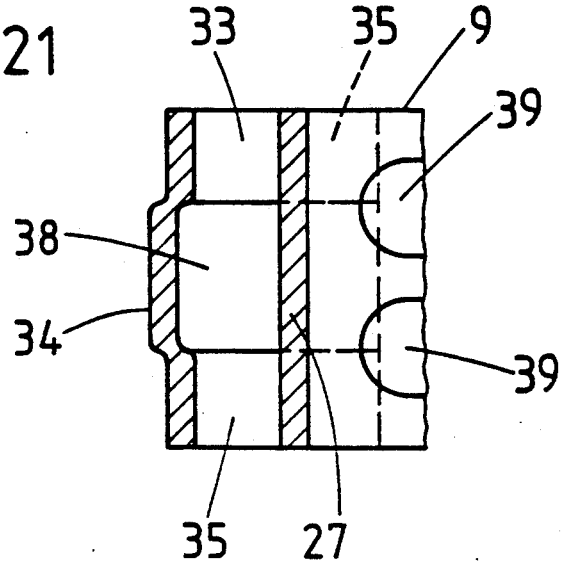
FIG. 21 shows a section taken along the line XXI—XXI in FIG. 17.

The folded-back first regions or portions 28 of the feet 27 are hereinafter designated as folded-back portions 34, each of which then continues into a folded-under second region or portion 35 (FIGS. 17 and 18). The folded-under portions are laterally inwardly directed, i.e., each runs transversely to the length of the latch rail I. From FIG. 17, as well as from some of the other figures, it can be clearly seen that the folded-under portions 35 are formed from the free end regions of the material tabs forming the feet 27. Each such free end region extends under a respective edge region 9' of the slider bottom. As can be furthermore gathered from FIG. 17, the inner crest or vertex between each folded-back portion 34 and its associated folded-under portion 35 runs in a concave arc 36. Each arc or bend 36 occupies substantially a third of the tab forming the peripheral portion of the associated deflection channel 33 for the cramp spike 31. The fabric-piercing cramp spikes 31 which enter via the insertion openings 29 are thereby deflected or deviated in the directions of the lateral edges of the rail 1 in a hooking manner, without, however, freely protruding there. On the contrary, the cramp spikes 31 remain covered in the gap-like deviation channels 33.

Figure 22:
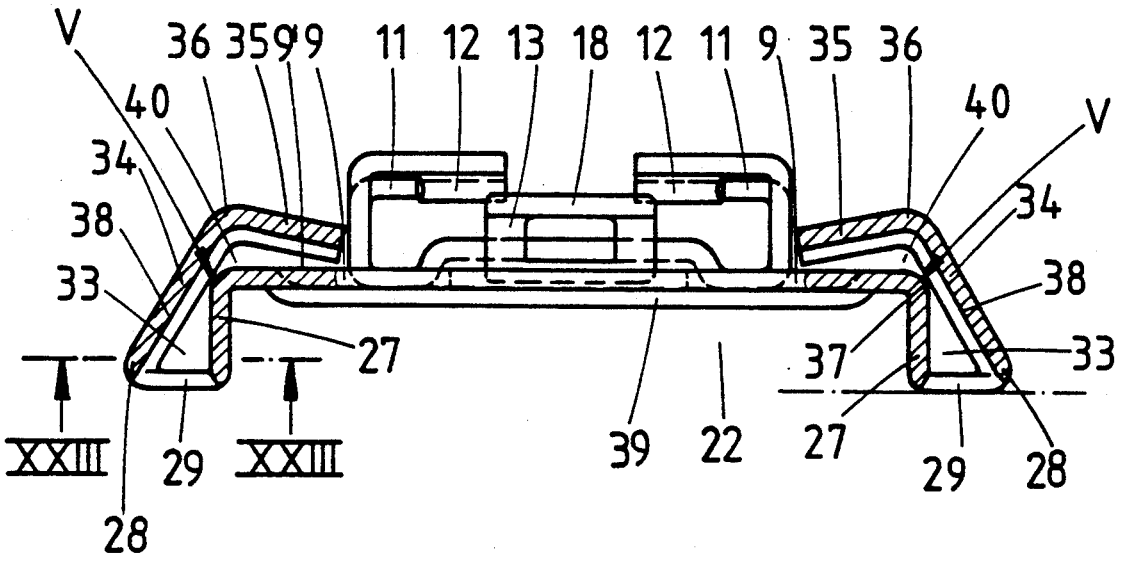
FIG. 22 shows a view similar to FIG. 17 but illustrates a modification of the deviation channel for the cramp spike.
Figure 23:
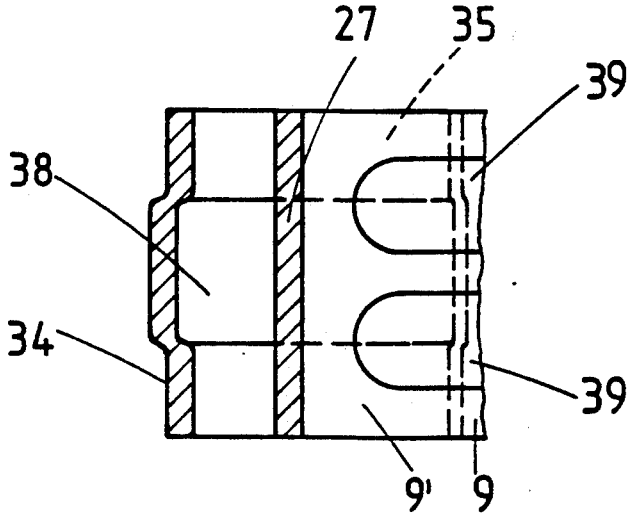
FIG. 23 shows a section taken along the line XXIII—XXIII in FIG. 22.

As can be furthermore seen from FIG. 17, in this modification the portions of the feet 27 which define the passageway or tunnel 22 and the folded-back regions or portions 34 which are located outwardly of the feet essentially run parallel to each other, with the folded-under regions or portions 35 being oriented at right angles to the portions 34 and the feet 27. On the other hand, the modification according to FIG. 22 provides a profile contour in which the folded-back regions or portions 34 run at opposite acute angles with respect to the feet 27. The angle of inclination in each case is approximately 30°. The respective inclined positions and the somewhat greater lengths of the folded-back portions 34 lead to the result that the respective concave arcs or bends 36, which here are somewhat more narrow, are situated behind, but slightly laterally inwardly of, the corner edges 37 between the slider bottom 9 and the feet 27. Due to the essentially right-angle bending of the folded-under portions 35 relative to the folded-back portions 34 also in this case, the portions 35 consequently extend obliquely, at likewise acute angles, toward the slider bottom 9.

In both variants, a continuously running guiding bead 38 is provided at the inner side of each foldedback portion 34 and folded-under portion 35 and the intermediate concave inner crest or vertex of the arc or bend 36. Its groove structure, which is realized by a simple wall displacement, can clearly be seen from FIGS. 21 and 23. The guiding bead 38 is adapted to the maximum width of the flat, symmetrically tapered cramp spike or tongue 31 (FIG. 20) and extends in the plane of symmetry of the feet 27 at both sides of a raised material zone which forms the non-beaded portion of the inner surface and approximately corresponds to half of the guiding bead width. The guiding bead 38 stabilizes that portion of the slider 2 which forms the abutment for the cramp deviation. A pair of beads 39 extends also in the same transverse direction and stiffen that region of the slider bottom 9 which is at the fastening side. A corresponding structural arrangement is also found in the modification according to FIG. 4.

In the modification according to FIG. 17, each cramp spike 31 at first, following the respective insertion direction, enters linearly into the starting portion of the associated deviation or deflection channel 33. According to the modification of FIG. 22, however, the hook-forming deflection or deviation of each cramp spike 31 takes place practically already at the beginning, immediately after moving through the respective frontal insertion opening 29. Here, the free end of each cramp spike 31 is forced through a respective narrowing region V which is located approximately in the middle region of the associated deviation channel 33 and is defined by means of the acute-angled orientation of the folded-back portion 34 and the proximity of the non-beaded portion of the inner surface of the portion 34 to the corner edge 37 between the slider bottom 9 and the associated foot 27.

In contrast thereto, the modification according to FIG. 17 provides a corresponding narrowing V at the inner end of each cramp spike deviation channel 33. Here too, the narrowing V goes to a width less than the corresponding thickness dimension of the cramp spikes 31. The preceding channel zone of each deviation channel 33 and the associated window-like, elongated rectangular insert opening 29, however, occupy a free section which is significantly greater than the free height of the inner end of the deviation channel 33. By Way of example, the channel width, measured in the thickness direction, corresponds approximately to two times the thickness dimension of the cramp spikes 31.

In all cases, after the application or insertion of each as before U-shaped cramp or staple 30 (FIG. 20), a three-layered wall formation is provided, which consists of the portion forming the foot 27, the cramp spike 31 and the bent folded-under material layer constituted by the folded-back portion 34, the crest or vertex 36 and the folded-under portion 35 (see FIG. 18). As regards the modification according to FIG. 22, there is even provided a rolling-in zone for the free end of each cramp spike 31, which exists in that profile by virtue of the practically three-sided free space 40. The corresponding rolled-in material swelling acts like an anchor lying against the underside of the slider bottom 9, which anchor cannot without more pass through the narrowed passage V in a direction opposite to the insertion direction of the cramp spike 31. This solution proves to be especially secure.

The operation of the embodiment according to FIGS. 12 to 23 corresponds to the operation described with respect to the first embodiment.

It will be understood that the foregoing description of preferred embodiments of the present invention is for purposes of illustration only, and that the various structural and operational features herein disclosed are susceptible to a number of modifications and changes none of which entails any departure from the spirit and scope of the present invention as defined in the hereto appended claims.

I claim:

1. A waistband fastener, especially for trousers, skirts or the like having first and second waistband portions arranged to overlie one another with said first waistband portion closer to the body of the wearer than said second waistband portion, which waistband fastener includes a latch rail fixed to said first waistband portion, a slider connected to said second waistband portion and guided on said latch rail for reciprocal movement therealong, said latch rail on a face thereof directed toward said first waistband portion being provided with a plurality of teeth of a sawtooth-like configuration spaced from each other by respective gaps bounded each by a steep flank of one tooth and a sloping flank of the next adjacent tooth, and a latch finger carried by said slider and adapted to enter into said gaps between the teeth of the latch rail; wherein the improvement comprises that:

(a) said latch rail has (i) a pair of lateral portions disposed at a distance from said first waistband portion, and (ii) a central upstanding foot extending longitudinally of said latch rail between said lateral portions and being in contact with and secured to said first waistband portion;

(b) said lateral portions on the faces thereof directed toward said first waistband portion are provided with respective sets of said sawtooth-like teeth;

(c) said slider has at its opposite side regions respective U-shaped legs open inwardly of, and overlapping the proximate outer border regions of, said lateral portions of said latch rail for guiding said slider along said latch rail, and further has respective latch fingers adapted to coact with and enter into the gaps between said teeth of the respective sets of teeth;

(d) said slider is arranged for transverse shifting jointly with said latch fingers relative to said latch rail toward and away from said first waistband portion for selectively positioning said latch fingers out of and in contact with said teeth as well as out of and in said gaps therebetween; and (e) said latch fingers are constructed and arranged to ride along and over said teeth in contact therewith and hence into and out of said gaps when said slider, while transversely shifted away from said first waistband portion, is moved lengthwise of said latch rail in the direction toward said sloping flanks of said teeth, and (ii) to be brought out of contact with said teeth and hence fully out of said gaps and clear of the tops and said steep flanks of said teeth so as to move freely past the latter when said slider, while transversely shifted toward said first waistband portion, is moved lengthwise of said latch rail in the direction toward said steep flanks of said teeth.

2. A waistband fastener according to claim 1; wherein the improvement further comprises a spring carried by said slider and bearing against said latch rail at a face thereof directed away from said first waistband portion for normally biasing said slider away from said first waistband portion and thereby for pressing said latch fingers into said gaps between the associated teeth of said latch rail.

3. A Waistband fastener according to claim 2; wherein said spring is a tongue projecting from the bottom of said slider and extends in the longitudinal direction of said slider.

4. A waistband fastener according to claim 3; wherein said tongue is constructed as a buckle spring hinged at one end to said slider.

5. A waistband fastener according to claim 2; wherein said spring has a root region which is arranged in juxtaposition to the guiding portions of said legs performing the guiding function.

6. A waistband fastener according to claim 5; wherein a convex surface is provided in the root region of said spring which extends over the entire transverse width of said slider and is directed toward the face of said latch rail directed away from said first waistband portion.

7. A waistband fastener according to claim 6; wherein said spring has a free end remote from said root region, said free end being arranged in juxtaposition to said latch fingers.

8. A waistband fastener according to claim 2; wherein said latch rail is provided with a sewing-on groove in registry with said foot at said face of said latch rail directed away from said first waistband portion, and the width of said spring is greater than the width of said sewing-on groove of said latch rail.

9. A waistband fastener according to claim 1; wherein said slider at each of said side regions thereof has a respective pair of said U-shaped legs which are spaced apart from each other in the direction of movement of said slider along said latch rail.

10. A waistband fastener according to claim 9; wherein said latch fingers are constituted by respective end regions of said legs which are prolongated beyond the portions of said legs performing the guiding functions.

11. A waistband fastener according to claim 1; wherein said latch rail is provided with a sewing-on groove in registry with said foot at said face of said latch rail directed away from said first waistband portion.

12. A waistband fastener, especially for trousers, skirts or the like having first and second waistband portions arranged to overlie one another with said first waistband portion closer to the body of the wearer than said second waistband portion, which waistband fastener includes a latch rail fixed to said first waistband portion, a slider connected to said second waistband portion and guided on said latch rail for reciprocal movement therealong, said latch rail on a face thereof directed toward said first waistband portion being provided with a plurality of teeth of a sawtooth-like configuration spaced from each other by respective gaps bounded each by a steep flank of one tooth and a sloping flank of the next adjacent tooth, and a latch finger carried by said slider and adapted to enter into said gaps between the teeth of the latch rail; wherein the improvement comprises that;

(a) said slider is arranged for transverse shifting jointly with said latch finger relative to said latch rail toward and away from said first waistband portion for selectively positioning said latch finger out of and in contact with said teeth as well as out of and in said gaps therebetween;

(b) means are associated with said slider and constructed to define a tunnel for accommodating a covering strip for said latch rail; and (c) said latch finger is constructed and arranged (i) to ride along and over said teeth in contact therewith and hence into and out of said gaps when said slider, while transversely shifted away from said first waistband portion, is moved lengthwise of said latch rail in the direction toward said sloping flanks of said teeth, and (ii) to be brought out of contact with said teeth and hence fully out of said gaps and clear of the tops and said steep flanks of said teeth so as to move freely past the latter when said slider, while transversely shifted toward said first waistband portion, is moved lengthwise of said latch rail in the direction toward said steep flanks of said teeth.

13. A waistband fastener according to claim 12, wherein said means defining said tunnel are constituted by feet projecting from the bottom of said slider, and said feet have bent-over end regions constituting respective cramp-fastening legs.

14. A waistband fastener according to claim 13; wherein said feet are constructed to define respective deviation channels for the spikes of a cramp.

15. A waistband fastener according to claim 14; wherein each said deviation channel is constituted by a first region of the respective foot provided with an insertion opening for a cramp spike and extending back along said foot following the location of said insertion opening, and by a second region of said foot extending from said first region substantially transversely thereto and under the proximate lateral edge region of the bottom of said slider.

16. A waistband fastener according to claim 15, wherein said first and second regions of each foot define a guiding bead at the inwardly directed faces thereof.

17. A waistband fastener according to claim 16; wherein those portions of said feet defining said tunnel and the respective first regions of said feet are oriented substantially parallel to each other, and said second regions are oriented substantially perpendicular to said first regions.

18. A waistband fastener according to claim 16, wherein the respective first regions of said feet are oriented at opposite acute angles relative to those portions of said feet defining said tunnel, the respective acute angles being such that each of said first regions in the non-beaded zone thereof either touches the corner edge defined between the bottom of said slider and the proximate foot or is spaced apart therefrom by a gap smaller than the thickness dimension of the cramp spike to be inserted between said foot and said first region.

19. A waistband fastener according to claim 18; wherein said second region of each foot is oriented at an acute angle relative to and slopes toward the bottom of said slider, thereby defining a rolling-round chamber for the free end of the cramp spike to be inserted between said foot and said first region.

20. A waistband fastener according to claim 16; wherein at their juncture said first and second regions of each foot define a concave arc.

21. A waistband fastener according to claim 15; wherein the cross-section of the part of each deviation channel located between the respective foot and said first region thereof tapers in the direction away from said insertion opening.

22. A waistband fastener according to claim 21; wherein the tapering cross-section of each deviation channel narrows down to below the corresponding thickness dimension of the cramp spike to be received therein, and at tis widest end adjacent said insertion opening the cross-section of the deviation channel is approximately two times the thickness dimension of the cramp spike to be inserted through said opening.

23. A waistband fastener, especially for trousers, skirts or the like having first and second waistband portions arranged to overlie one another with said first waistandd portion closer to the body of the wearer than said second waistband portion, which waistband fastener includes a latch rail fixed to said first waistband portion, a slider connected to said second waistband portion and guided on said latch rail for reciprocal movement therealong, said latch rail having opposite faces directed toward and away from said first waistband portion, respectively, and being provided on said face directed toward said first waistband portion with a plurality of teeth spaced from each other by respective gaps each bounded by a flank of one tooth and the proximate flank of the next adjacent tooth, and a latch finger carried by said slider and adapted to enter into said gaps between the teeth of the latch rail; wherein the improvement comprises that:

(a) said slider is arranged for transverse shifting thereof jointly with said latch finger relative to said latch rail away from and toward said first waistband portion through a distance at least equal to the height of said teeth for selectively positioning said latch finger in and out of said gaps between said teeth so as to be either in a position to engage said flanks of said teeth or in a position to clear the tops of said teeth; and (b) said latch finger is constructed and arranged to be brought out of said gaps and clear of the tops and said flanks of said teeth so as to move freely past the latter when said slider, while transversely shifted toward said first waistband portion, is moved lengthwise of said latch rail.

24. A waistband fastener according to claim 23; wherein the improvement further comprises a spring carried by said slider and slidably baring against said face of said latch rail directed away from said first waistband portion, said spring serving to apply a biasing force to said slider so as to normally shift said slider away from said first waistband portion, thereby to bring said latch finger into said gaps between said teeth of said latch rail and into said position to engage said flanks of said teeth.

25. A waistband fastener according to claim 24; wherein said spring is a tongue projecting from the body of said slider and extends longitudinally of the direction of movement of said slider along said latch rail.

26. A waistband fastener according to claim 25; wherein said tongue is constructed as a buckle spring hinged at one end to said slider.

27. A waistband fastener according to claim 23; wherein the improvement further comprises that:

(c) said latch rail has (i) a pair of lateral portions disposed at a distance from said first waistband portion, and (ii) a central upstanding foot at said face of said latch rail directed toward said first waistband portion, said foot extending longitudinally of said latch rail between said lateral portions and being in contact with and secured to said first waistband portion;

(d) said lateral portions on the faces thereof directed toward said first waistband portion are provided with respective sets of said teeth;

(e) said slider has at its opposite side regions respective U-shaped legs open inwardly of, and overlapping the proximate outer border regions of, said lateral portions of said latch rail for guiding said slider along said latch rail; and (f) said slider further has respective latch fingers adapted to coact with and enter into the gaps between said teeth of the respective sets of teeth.

28. A waistband fastener according to claim 27; wherein said latch rail is provided with a sewing-on groove in registry with said foot at said face of said latch rail directed away from said first waistband portion.

29. A waistband fastener according to claim 27; wherein said slider at each of said side regions thereof has a respective pair of said U-shaped legs which are spaced apart from each other in the direction of movement of said slider along said latch rail.

30. A waistband fastener according to claim 27; wherein said latch fingers are constituted by respective end regions of said legs which are prolongated beyond the portions of said legs performing the guiding function.

31. A waistband fastener according to claim 27; wherein the improvement further comprises a spring carried by said slider and slidably bearing against said face of said latch rail directed away from said first waistband portion, said spring serving to apply a biasing force to said slider so as to normally shift said slider away from said first waistband portion, thereby to bring said latch finger into said gaps between said teeth of said latch rail and into said position to engage said flanks of said teeth.

32. A waistband fastener according to claim 31; wherein said spring is a tongue projecting from the body of said slider and extends longitudinally of the direction of movement of said slider along said latch rail.

33. A waistband fastener according to claim 31; wherein said tongue is constructed as a buckle spring hinged at one end to said slider.

34. A waistband fastener according to claim 31; wherein said spring has a root region which is arranged in juxtaposition to the portions of said legs performing the guiding function.

35. A waistband fastener according to claim 34; wherein a convex surface is provided in said root region of said spring which extends over the entire transverse width of said slider and is directed toward said face of said latch rail directed away from said first waistband portion.

36. A waistband fastener according to claim 34 or 35; wherein said spring has a free end remote from said root region, said free end being arranged in juxtaposition to said latch fingers.

37. A waistband fastener according to claim 31; wherein said latch rail is provided with a sewing-on groove in registry with said foot at said face of said latch rail directed away from said first waistband portion, and the width of said spring is greater than the width of said sewing-on groove of said latch rail.

38. A waistband fastener according to claim 23; wherein the improvement further comprises means associated with said slider and defining a tunnel for accommodating a covering strip for said latch rail.

39. A waistband fastener according to claim 38; wherein said tunnel is constituted by feed projecting from the body of said slider, and said feet have bent-over end regions constituting respective cramp-fastening legs.

40. A waistband fastener according to claim 39; wherein said feet are constructed to define respective deviation channels for the spikes of a cramp.

41. A waistband fastener according to claim 40; wherein each said deviation channel is constituted by a first region of the respective foot provided with an insertion opening for a cramp spike and extending back along said foot following the location of said insertion opening, and by a second region of said foot extending from said first region substantially transversely thereto and under the proximate lateral edge region of the body of said slider.

42. A waistband fastener according to claim 41; wherein the cross-section of the part of each deviation channel located between the respective foot and said first region thereof tapers in the direction away from said insertion opening.

43. A waistband fastener according to claim 42; wherein the tapering cross-section of each deviation channel narrows down to below the corresponding thickness dimension of the cramp spike to be received therein, and at its widest end adjacent said insertion opening the cross-section of the deviation channel is approximately two times the thickness dimension of the cramp spike to be inserted through said opening.

44. A waistband fastener according to claim 41; wherein said first and second regions of each foot define a guiding bead at the inwardly directed faces thereof.

45. A waistband fastener according to claim 44; wherein at their juncture said first and second regions of each foot define a concave arc.

46. A waistband fastener according to claim 44, wherein those portions of said feet defining said tunnel and the respective first regions of said feet are oriented substantially parallel to each other, and said second regions are oriented substantially perpendicular to said first regions.

47. A waistband fastener according to claim 44; wherein the respective first regions of said feet are oriented at opposite acute angles relative to those portions of said feet defining said tunnel, the respective acute angles being such that each of said first regions in the non-beaded zone thereof either touches the corner edge defined between the body of said slider and the proximate foot or is spaced apart therefrom by a gap smaller than the thickness dimension of the cramp spike to be inserted between said foot and said first region.

48. A waistband fastener according to claim 47; wherein said second region of each foot is oriented at an acute angle relative to and slopes toward the body of said slider, thereby defining a rolling-round chamber for the free end of the cramp spike to be inserted between said foot and said first region.

* * * * *